US011760443B2

(12) United States Patent
Wang et al.

(10) Patent No.: US 11,760,443 B2
(45) Date of Patent: Sep. 19, 2023

(54) BUOY APPARATUS AND THE CONTROL SYSTEM

(71) Applicants: Libo Wang, Halifax (CA); Xiaoge Cheng, Beijing (CN)

(72) Inventors: Libo Wang, Halifax (CA); Xiaoge Cheng, Beijing (CN)

( * ) Notice: Subject to any disclaimer, the term of this patent is extended or adjusted under 35 U.S.C. 154(b) by 75 days.

(21) Appl. No.: 17/200,949

(22) Filed: Mar. 15, 2021

(65) Prior Publication Data

US 2021/0339832 A1 Nov. 4, 2021

Related U.S. Application Data

(60) Provisional application No. 63/019,360, filed on May 3, 2020.

(51) Int. Cl.

| | |
|---|---|
| ***B63B 22/08*** | (2006.01) |
| ***B63B 22/18*** | (2006.01) |
| ***B63B 22/06*** | (2006.01) |
| ***B63B 22/00*** | (2006.01) |

(52) U.S. Cl.

CPC ..... *B63B 22/08* (2013.01); *B63B 22/06* (2013.01); *B63B 22/18* (2013.01); *B63B 2022/006* (2013.01)

(58) Field of Classification Search

CPC ..... B63B 22/06; B63B 22/08; B63B 22/18; B63B 2022/00; B66D 1/04; B66D 1/28; B66D 1/32

USPC ..... 441/2

See application file for complete search history.

(56) References Cited

U.S. PATENT DOCUMENTS 3,722,014 A * 3/1973 Hill ..... B63B 22/06 367/133

FOREIGN PATENT DOCUMENTS

CA 3038171 A1 * 9/2020 ..... B63B 22/06

* cited by examiner

*Primary Examiner* — Daniel V Venne

(57) ABSTRACT

Buoy apparatus and buoy control system for identifying an underwater object, and method for identifying an underwater object are disclosed. A buoy apparatus for use underwater, comprises a buoy securely connected to a first end of a rope; a spool structure securely connected to a second end of the rope; a retractable head for engaging the spool structure; and a spool control device for actuating retraction of the retractable head, wherein in response to an instruction from the spool control device, the retractable head disengages the spool structure, and the spool structure releases the rope when the buoy raises toward a surface of water.

15 Claims, 19 Drawing Sheets

BUOY APPARATUS AND THE CONTROL SYSTEM

FIELD OF THE INVENTION

The present disclosure relates generally to marking an underwater object, in particular to a buoy apparatus a buoy control system, and a method for identifying an underwater object.

BACKGROUND

A buoy apparatus is used for marking the position of underwater objects and/or pulling the objects up with a connected rope. Existing buoy apparatuses mainly comprise two portions: one above water for indicating the position of an underwater object and the other part is under the water for connecting or pulling underwater object. The above water portion may be a buoy with a color; the underwater portion comprises an object and a rope with one end connecting to the object. The rope with the other end connects to the buoy. To retrieve the underwater object, first thing to do is to locate the buoy and then pull the rope out of the water.

However, when these buoy apparatuses are densely distributed in the ocean, the ropes form net-like obstacles that pose a threat to the lives of marine organisms. For instance, marine organisms may be entangled in the net-like obstacles from which they cannot escape and may die.

SUMMARY OF THE INVENTION

The embodiments of the present invention provide a buoy apparatus and a buoy control system for marking the underwater object. The ropes of the buoy apparatus and the buoy control system only extends to the surface of the water only triggered by instructions.

According to an aspect, there is provided a buoy apparatus for use underwater, comprises a buoy securely connected to a first end of a rope; a spool structure securely connected to a second end of the rope; a retractable head for engaging the spool structure; and a spool control device for actuating retraction of the retractable head, wherein in response to an instruction from the spool control device, the retractable head disengages the spool structure, and the spool structure releases the rope when the buoy raises toward a surface of water.

According to another aspect, there is provided A method for identifying an object underwater attached to a buoy apparatus, the apparatus having a buoy tied to an end of a rope, a spool structure winded or coiled by the rope, and a retractable head engaging the spool structure, comprising: receiving an instruction to retract the retractable head; in response, disengaging the retractable head from the spool structure; and releasing the rope from the spool structure when the buoy raises toward a surface of water.

To solve the problem mentioned above, the present invention discloses a buoy apparatus (1), being applied underwater, comprising: a spool control device (11), a spool structure (12) and a buoy (13);

Wherein, said spool control device (11) comprising: a first microprocessor module (111) for generating decoupling instructions and a decoupling control module (112) connecting to said first microprocessor module (111);

Said spool structure (12) comprising: connecting rods (121), one end of each said connecting rod (121) being fixed on the first spool flange (122), the other end of each said connecting rod being fixed on the second spool flange (123), a rope winding around said connecting rods (121), a decoupling electric motor device (124) connecting to the central shaft of the spool structure (12), said decoupling electric motor device (124) being positioned to the outer side of said first spool flange (122), said first spool flange (122) being engaged with a retractable head of said decoupling electric motor device (124) when the head extending, when the retractable head of said decoupling electric motor device (124) retracting, said first spool flange (122) being released;

Said buoy (13) having a rope fixing ring (131) on the bottom, said buoy (13) being connected with a rope through said rope fixing ring (131).

Further, said spool structure (12) also comprising: a manual spin handle (125) and a spool holder (126), said manual spin handle (125) connecting to said second spool flange (123), said spool holder (126) being set at the same side of said first spool flange (122).

Further, said buoy (13) being also internally set up with a second microprocessor module (132), a battery module (133) connecting to said second microprocessor module (132), a first communication module (134) connecting to said second microprocessor module (132) and a SIM slot (135) connecting to said first communication module (134).

Further, said buoy (13) being also internally set up with an automatic power-on module (136), one end of said automatic power-on module (136) connecting to said battery module (133) and the other end connecting to said second microprocessor module (132).

Further, said automatic power-on module (136) comprising: a protective cover (1361); said protective cover (1361) being externally set up with two terminals (1362), said two terminals (1362) respectively connecting to the positive electrode of said battery module (133) and to the positive electrode of the second microprocessor module (132); said protective cover (1361) being internally set up with two wire columns (1363), a crimping board (1364), two springs (1365) and a conductive plate (1366), said wire columns (1363) respectively connecting to said terminals (1362), one end of said springs (1365) connecting to said wire columns (1363) via said crimping board (1364), another end of said springs (1365) connecting to said rope fixing ring (131) via the conductive plate (1366)

Further, said buoy apparatus (1) also comprising: a first communication device (14); said spool control device (11) also comprising: a first communication interface module (113) with one end connecting to said first communication device (14) and another end connecting to said first microprocessor module (111).

Besides, solving the problem mentioned above, the present invention includes a buoy control system, comprising the buoy apparatus (1) described above and a control signal generating device (2) capable to communicate with said buoy apparatus (1), said buoy apparatus (1) being underwater and connecting to underwater objects, said control signal generating device (2) being set up for users;

Wherein, said control signal generating device (2) comprising: a second communication device (21) and a control device (22) connecting to said second communication device (21);

Wherein, said control device (22) comprising: a second communication interface module (221), a third microprocessor module (222) and a control signal generating module (223), said second communication interface module (221) with one end connecting to said second communication device (21) and with another end connecting to said third microprocessor module (222), said control signal generating module (223) connecting to said third microprocessor module (222).

Further, said control device (22) also comprising: a display module (224), said display module (224) connecting with said third microprocessor module (222).

Further, the control signal generating device (2) also comprising: a holding structure (23), said second communication device (21) being fixed on said holding structure (23).

Further, said holding structure (23) comprising: two sliding rails (231); a device holding station (232) being set up on said sliding rails (231), said device holding station (232) and said sliding rails (231) being connected via sliding in between; the two ends of each said sliding rail (231) being respectively held by a bracket (233); each said bracket (233) having a fixing portion (234), said bracket (233) and said fixing portion (234) being firmly connected.

Comparing with the prior art, the technical solution of the present invention has a first microprocessor module of the spool control device capable to generate a decoupling instruction. Following the instruction, a decoupling control module instructs a retractable head of a decoupling electric motor device in the spool structure to extend or retract. When the retractable head extends, the first spool flange is engaged with it. The spool structure is locked. When the retractable head retracts, the first spool flange is released. The spool structure is unlocked. Meanwhile, since a rope connects with a buoy, buoyancy pulls the rope from the spool, thereby, bringing the entire buoy apparatus floating. Since the rope initially winds or coiled around the spool, the technical solution of the present invention has no rope suspending in water. Thus, it solves the problem from the prior art that buoys with ropes suspending in water pose a threat to the survival of marine organisms.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1A:
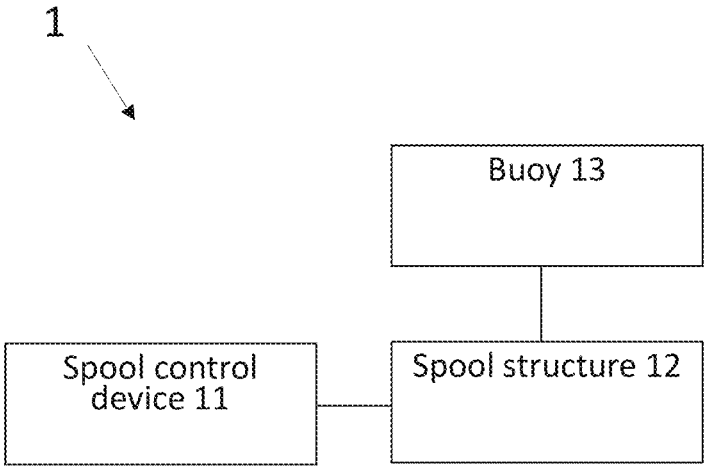
FIG. 1A is a schematic diagram of a buoy apparatus, according to an embodiment of the present disclosure.

Referring to the drawings, the embodiments of the present invention are further in detail illustrated below. It is understood that the specific embodiments described herein are only the explanations to associated inventions, rather than restrictions to the present invention. In addition, to easily describe, only the parts related to the invention are shown in the drawings.

It needs to be noted, in the absence of conflict, the embodiments and the embodiment features of the present invention can be combined with each other. Referring to the drawings and the embodiments, the present invention is in detail illustrated below.

To solve the problem that buoys with ropes pose a threat to the survival of marine organisms, the embodiments of the present invention provide a buoy apparatus and a buoy control system.

Figure 1B:
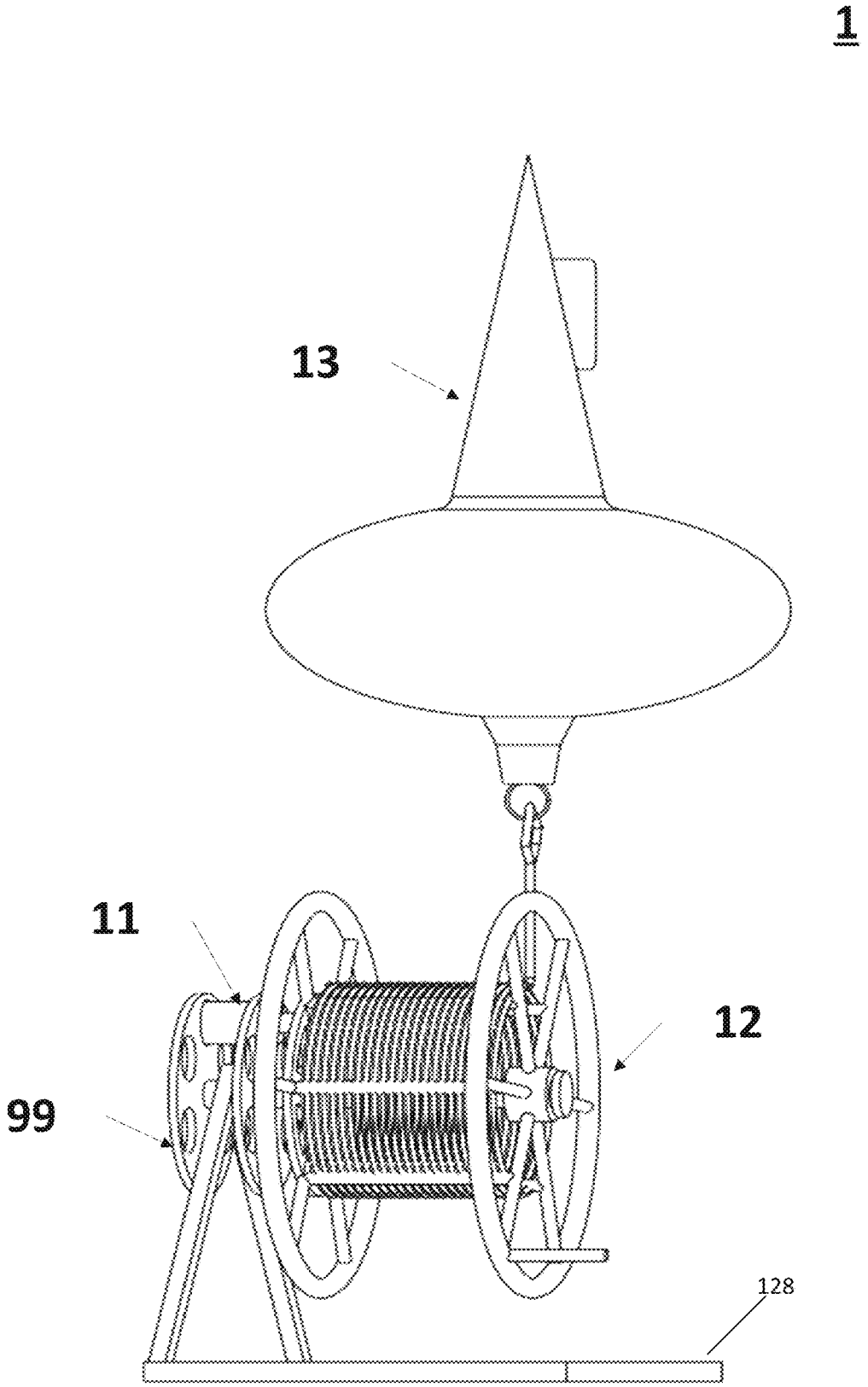
FIG. 1B is a perspective view of an exemplary buoy apparatus in FIG. 1, according to an embodiment of the present disclosure.

In the example of FIGS. 1A and 1B, a buoy apparatus 1 may be used underwater. The buoy apparatus 1 may include a spool control device 11, a spool structure 12, and a buoy 13. As illustrated in the example of FIG. 1B, the buoy 13 may be secured to an end of a string, rope, or strip, which is winded on the spool structure 12. The buoy 13 may be made by materials afloat in the water, such as polyethylene. The other end of the rope may be secured to the spool structure 12 (not shown). The spool structure 12 and the spool control device 11 may be installed on a rack 99. The rack 99 is configured to permit the spool structure 12 rotate when the spool control device 11 unlock the spool structure 12 and when the buoy 13, due to the buoyance of the water, raises toward the surface of the water. In the example of FIG.

1B, the rack 99 has a height that provides a free space between the bottom of the spool structure 12 and the base of the rack 99.

Figure 2:
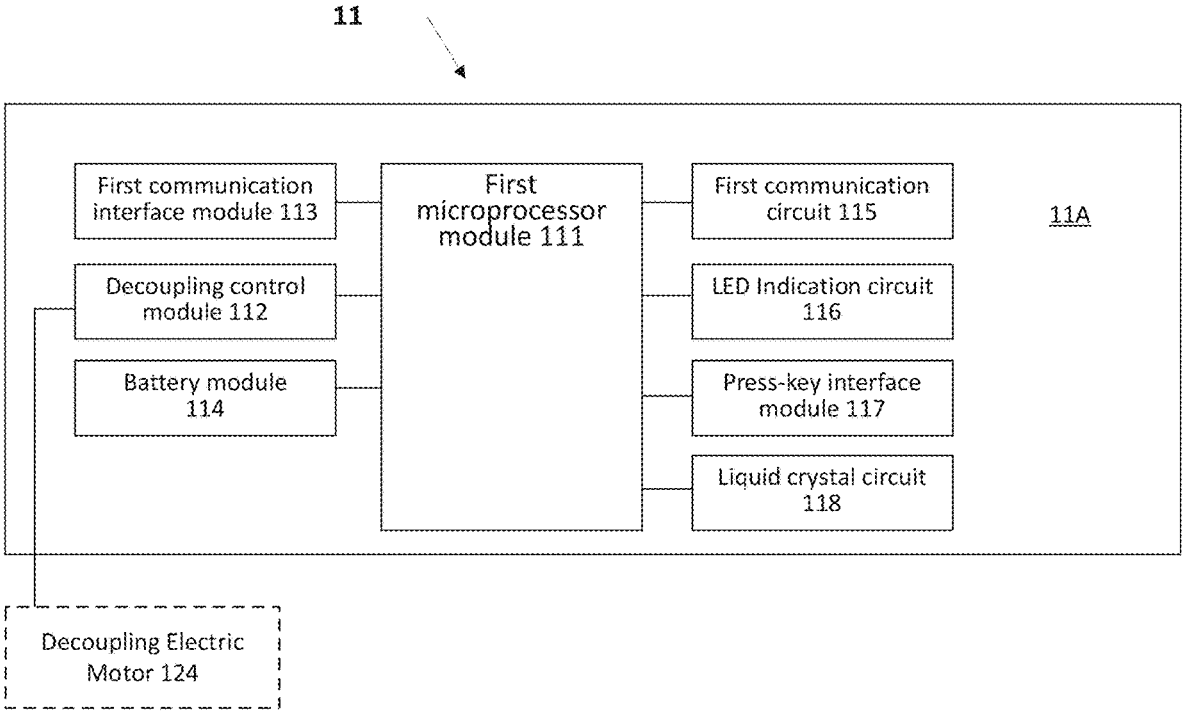
FIG. 2 is a block diagram of a spool control device of the buoy apparatus in FIG. 1, according to an embodiment of the present disclosure.

In some examples, an object to be identified in the water, such as a lobster trap cage, may be secured to the base 128 (FIG. 1B) of the buoy apparatus 1, and the object and the buoy apparatus 1 may be thrown into the water, such as from a boat. The object and the buoy apparatus 1 sink into the water due to the gravity. When the spool control device 11 unlock the spool structure 12 in the water, the buoy 13 and the end of the rope raise toward the water, and the raise of the rope causes the spool structure 12 to rotate to release the rope in the water until the buoyance of the buoy 13 is substantially the same as the gravity of the rope or of the buoy apparatus 1. In the example of FIG. 2, the spool control device 11 may include a decoupling electric motor device 124 and a control module 11A. The control module 11A may include a first microprocessor module 111 for generating decoupling instructions, and a decoupling control module 112 electrically connecting to the first microprocessor module 111 for receiving the instructions from the first microprocessor module 111. In response to the instructions received from the first microprocessor module 11, the decoupling control module 112 may selectively actuate the decoupling electric motor device 124 of the spool structure 12 to lock or unlock the spool structure 12.

In some examples, the control module 11A may also include a first communication interface module 113 and a first communication circuit 115. The first communication interface module 113 allows the spool control device 11 to communicate with other communication devices by using a communication device 14 in FIG. 5 to be described below. The communication device 14 may include Sonar, laser communication devices. The first communication circuit 115 may process the communication signals generated from the spool control device 11*a*, such as by the microprocessor module 111, or signals received by the first communication interface module 113. For example, the first communication circuit 115 may modulate, demodulate, encode or decode the signals.

In some examples, the spool control device 11 may only include the control module 11A, and the decoupling electric motor device 124 may be a stand-alone device mounted on the rack 99.

As shown in the example of FIG. 2, the spool control device 11 may also include a battery module 114. The battery module 114 electrically connects to and supplies power to the first microprocessor module 111. The battery module 114 may be a lithium battery module or other power supply modules.

Optionally, in order for the buoy apparatus 1 to be more accessible in use, as illustrated in FIG. 2, the spool control device 11 may also include a LED indication circuit 116, press-key interface module 117 and a liquid crystal circuit 118. The LED indication circuit 116, the press-key interface module 117 and the liquid crystal circuit 118 are respectively connected to the first microprocessor module 111. The LED indication circuit 116 may be used to indicate the operational status, such as hibernate, work, or triggered, of the microprocessor module 111. The press-key interface module 117 may be used for a user to manual configure parameters of the spool control device 11. For example when the buoy apparatus 1 is not in the water, a user may configure the time, such as 12 hours, for the microprocessor module to trigger decoupling control module 112, which may in turn trigger the decoupling electric motor 124 to release the buoy 13 when the time is expired. The liquid crystal circuit 118 may be display the information of the spool control device 11, such as remaining life of the battery module 114. Certainly, these modules, circuits and so on are only as the specific examples. In actual, other functional modules or circuits may be added based on requirements, which is not described herein.

Figure 3A:
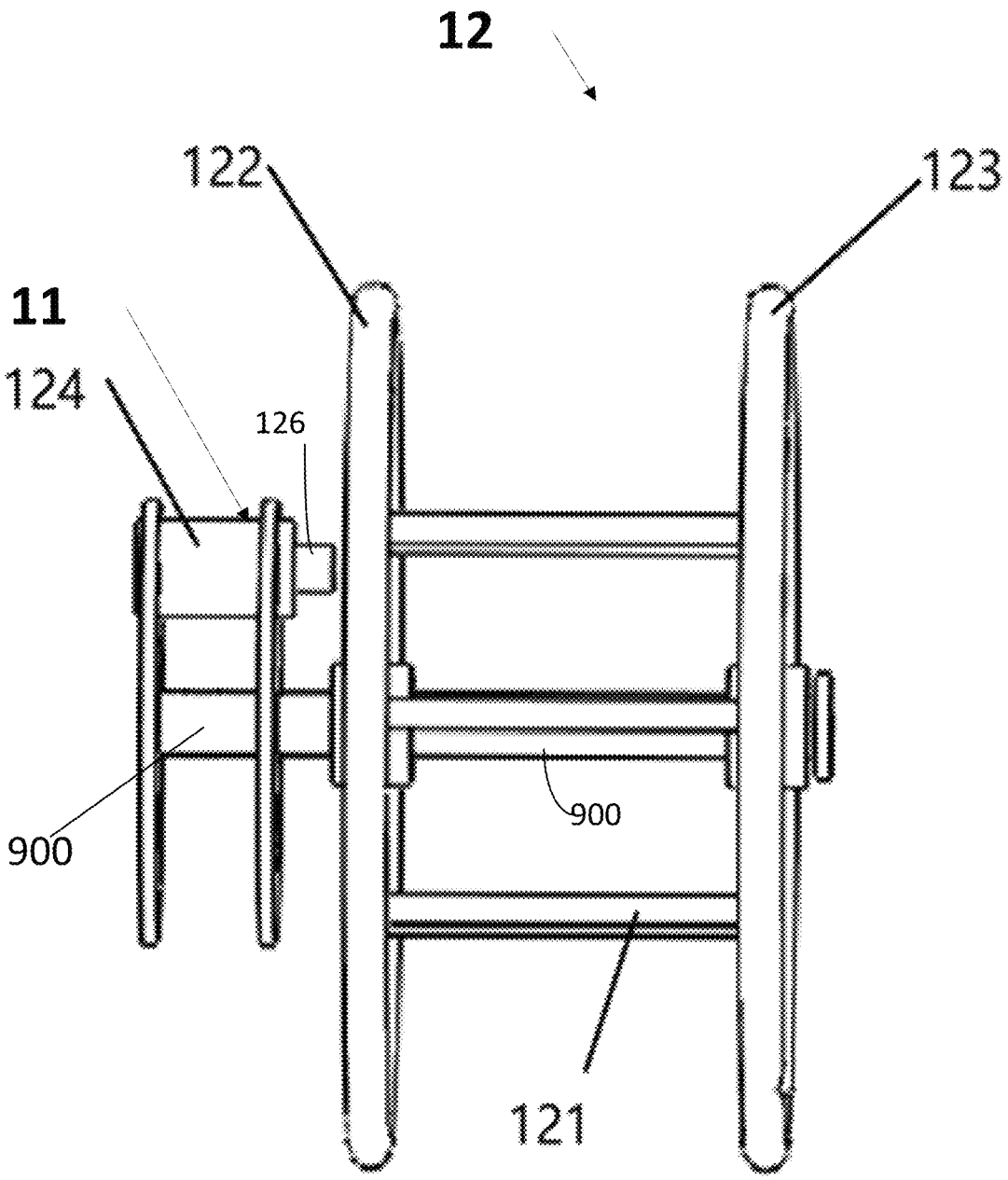
FIG. 3A is front view of an exemplary spool structure of the buoy apparatus in FIG. 1 in an unlocked state, according to an embodiment of the present disclosure.
Figure 3B:
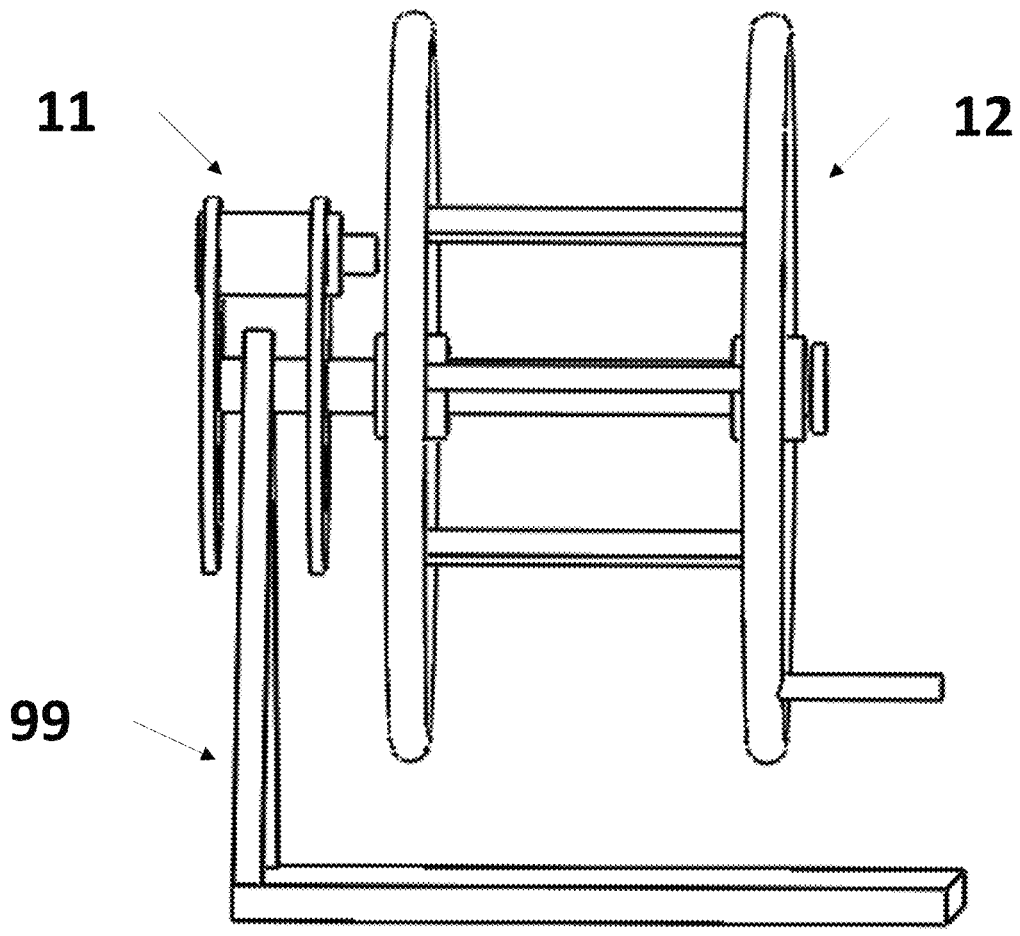
FIG. 3B is a perspective view of the spool structure of FIG. 3A mounted on a rack, according to an embodiment of the present disclosure.

In the example of FIG. 3A, the spool structure 12 may include a plurality of connecting rods 121 and a first and second spool flanges 122 and 123. The connecting rods 121 have two ends, one end of each connecting rod 121 being securely connected on the first spool flange 122, the other end of each connecting rod being securely connected on the second spool flange 123. FIG. 3B illustrates an example that the spool structure 12 and the spool control device 11 are mounted on the rack 99.

Figure 4:
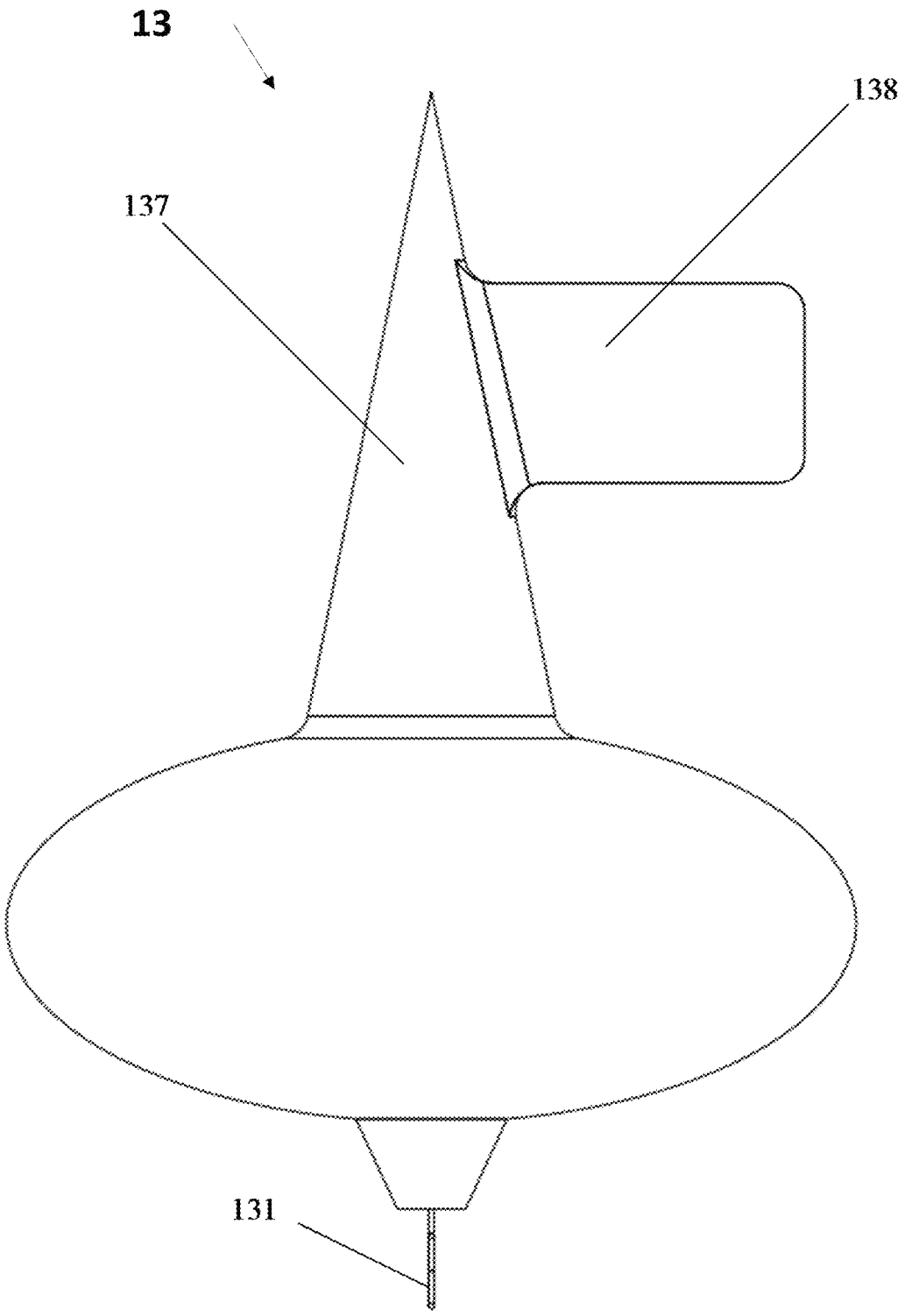
FIG. 4 is a front view of a buoy of the buoy apparatus in FIG. 1, according to an embodiment of the present disclosure.

As depicted in FIG. 4, a buoy 13 has a rope fixing ring 131 on the bottom for securely connecting to an end of the rope or string. The buoy 13 may be connected to a rope through the rope fixing ring 131. The other end of the rope may be securely connected to the spool structure 12, such as to one of the connecting rods 121. A rope or string tied to a buoy ring 131 may be winded on the connecting rods and between the first and second spool flanges 122 and 123.

The decoupling electric motor device 124 may connect to an outer side of the first or second spool flange 122 or 123. In some examples, the decoupling electric motor device 124 may connect to a central shaft 900 of the spool structure 12 at the outer sider of the first spool flange 122. The first spool flange 122 is engaged with a retractable head 126 of the decoupling electric motor device 124 when the head extends to the first spool flange 122, and the spool flanges 122 and 123 is fixed and not rotatable in the water. When the retractable head of the decoupling electric motor device 124 retracts from the first spool flange, the first spool flange 122 is released and when the buoy 13 raises toward the surface of the water, the spool flanges 122 and 123 is rotatable in the water to unwind the rope. When the first spool flange 122 is released from the retractable head 126, in response to the buoyance generated by the buoy 13, the buoy 13 pulls the rope with one end fixed on the rope fixing ring 131 and the rope raises towards the surface of the water with the buoy 13. The entire buoy apparatus 1 rises by buoyancy until the buoy 13 is above the surface of the water.

The retractable head 126 of the decoupling electric motor device 124 may be triggered to retract by the first microprocessor module 111 in several manners. For example, the timer set by the microprocessor module 111 as described above is expired; in response to the instructions of the user to release the buoy 13 provided by the communication device 14 in FIG. 5, the communication interface module 113 receives the instructions; the remaining life of the battery module 114 is low, such as in 10 days. In these examples, the first microprocessor module 111 may instruct the decoupling control module 112 to retract the retractable head 126. In response, the decoupling electric motor device 124 may be actuated to retract the retractable head 126. The decoupling electric motor device 124 may have a power of 16 watts, and may be a relay control motor or a driver motor. The decoupling electric motor device 124 may source power form the battery module 114.

In some examples, the first microprocessor module 111 may generate decoupling instructions at a predetermined time, for example, a time set by a user based on the actual needs, such as 12 hours, one day, or one week before the buoy apparatus 1 is placed into the water. The microprocessor module 111 may be a processor or a Central Processing unit (CPU). In some examples, the first microprocessor module 111 may have a timer. When the timer reaches the pre-determined time, the first microprocessor module 111 may generate one or more decoupling instructions to cause the decoupling control module 112 to decouple the retractable head 126. In some examples, the first microprocessor module 111 may monitor the status of the battery module 114, and may also generate a decoupling instruction when the battery module 114 is in a low-battery state or when an alarm of a low-battery is triggered.

Figure 5:
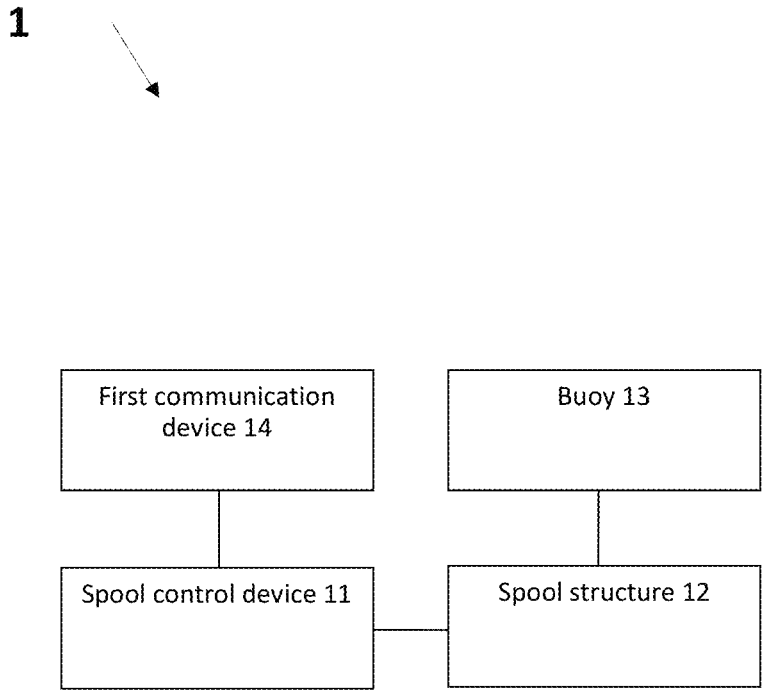
FIG. 5 is a schematic diagram of a buoy apparatus, according to another embodiment of the present disclosure.
Figure 8A:
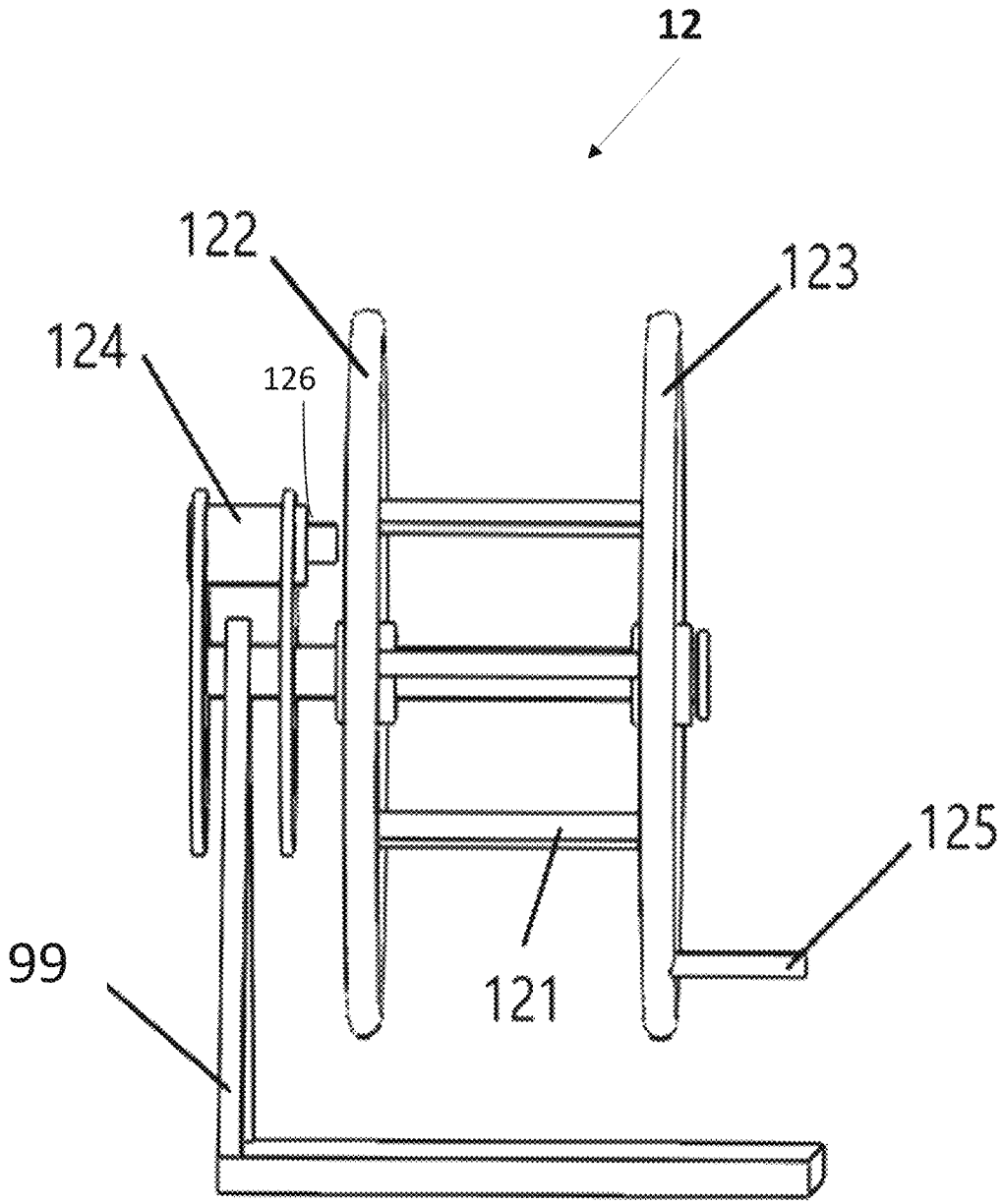
FIG. 8A is a front view of the spool structure in the buoy apparatus in FIG. 1 mounted on a rack and in an unlocked state, according to another embodiment of the present disclosure.
Figure 8B:
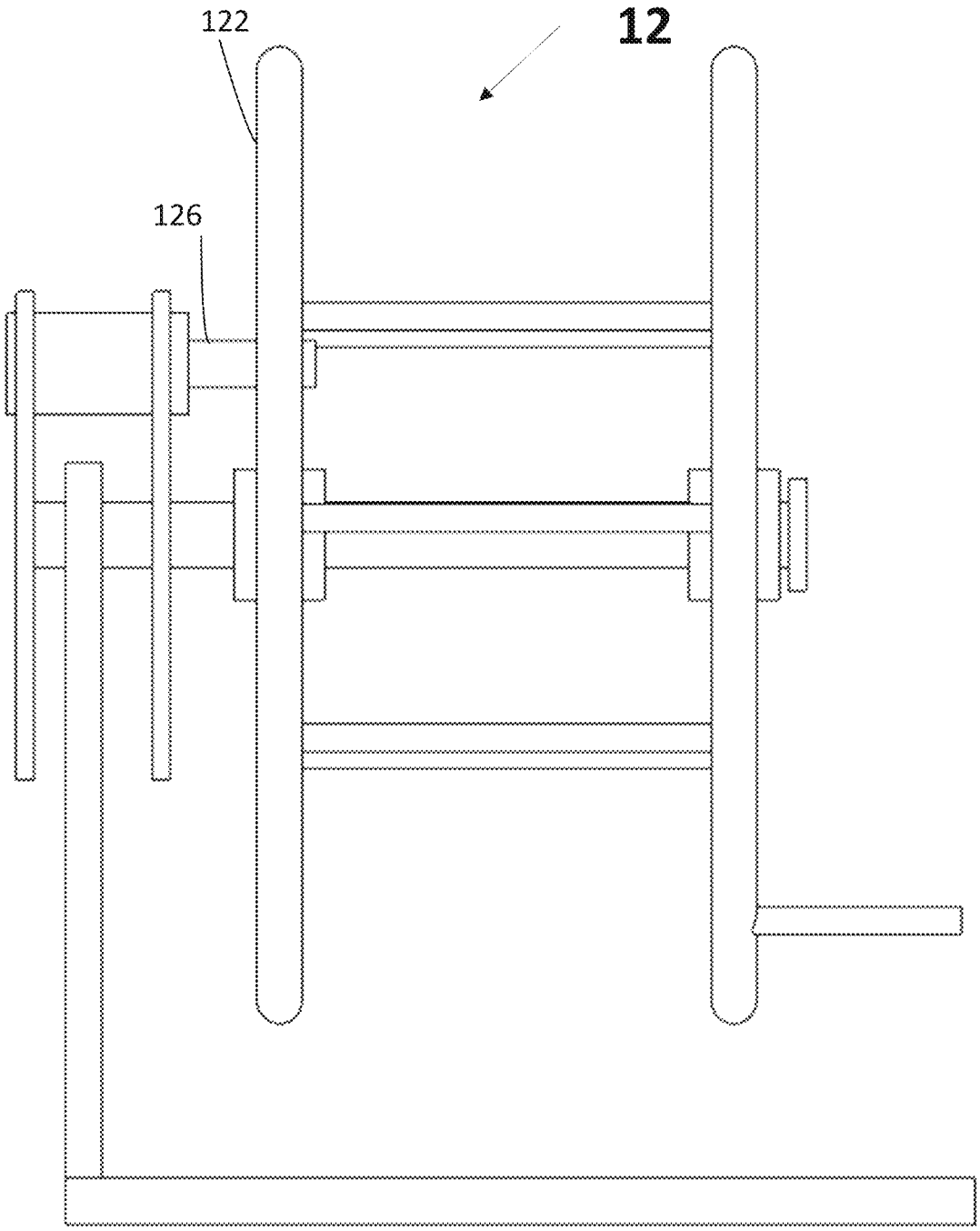
FIG. 8B is a perspective view of the spool structure mounted on a rack and in a locked state, according to an embodiment of the present disclosure.
Figure 8C:
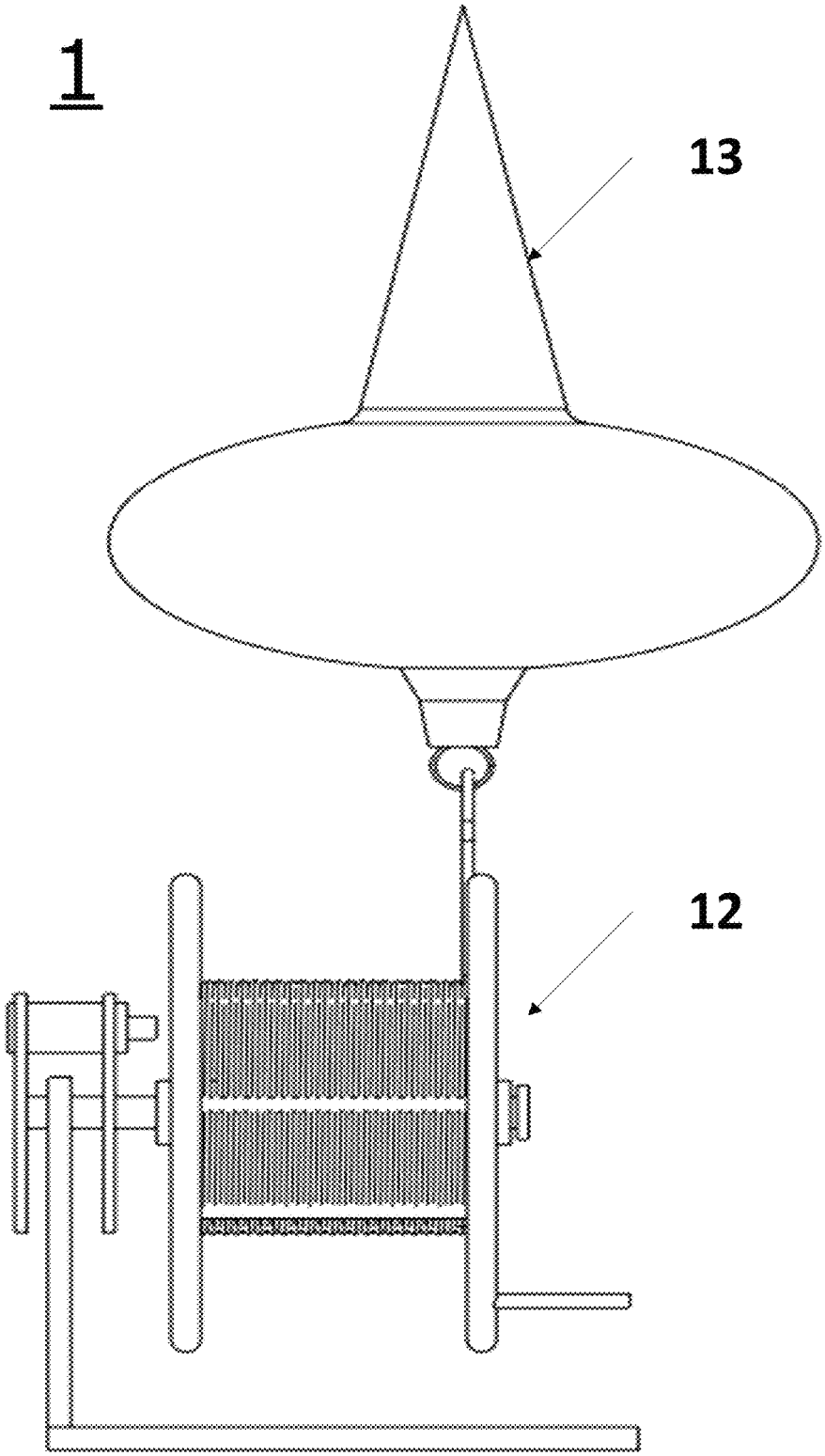
FIG. 8C is a front view of the buoy apparatus in FIG. 1 in an unlocked state, according to another embodiment of the present disclosure.

Optionally, a user may also manually cause the first microprocessor module 111 to generate a decoupling instruction, for example, by pressing a remote control button of a communication device. In the example of FIG. 5, the buoy apparatus 1 may further include a first communication device 14 mounted to the spool control device 11 for this purpose. The communication device 14 may include Sonar, laser communication devices. As described in the example of FIG. 2, the spool control device 11 may also include the first communication interface module 113. The first communication interface module 113 may electrically connect with the first communication device 14. As such, the first communication device 14 and the first microprocessor module 111 may wiredly or wirelessly communicate with each other via the first communication interface module 113. For example, after a person on a boat places an object, such as a lobster trap cage, and the buoy apparatus 1 into the water, the person may record the GPS location of the object and the and the buoy apparatus 1. The retractable head 126 is in a lock state (FIG. 8B) when the buoy apparatus land the object are placed into the water, and remain in the lock state until the retractable head 126 is retracted to an unlocked state (FIG. 8A). FIG. 8C is an example showing the buoy apparatus 1 is in an unlocked state. The person may come back to the same location after a period of time, such as one week. The person may use a communication device on the boat, such as a Sonar or laser device, to send instructions to the communication device 14 underwater. The first communication device 14 may receive user instructions from the communication device, and may forward the instructions to the first communication interface module 113, and the first communication interface module 113 may send the instructions to the first microprocessor module 111. In response to the instructions received from the first communication device 14, the first microprocessor module 111 instructs the decoupling control module 112 to decouple the rope from the spool structure 12. In response, the decoupling control module 112 actuate retractable head 126 of the decoupling electric motor device 124 to unlock the spool structure 12 so that the buoy 13 may raise toward the surface of the water. The buoy 13, the buoy device 1, and the object may be retrieved out from the water, for example, by pulling the rope by a person on a boat.

In addition, as underwater application of the buoy apparatus 1 may limit the communication capability of the first communication device 14, such as reduced communication distance, and increased channel loss and power consumption, the first communication device 14 may be a transducer with low power consumption and anti-interference capabilities, for example by using Sonar communication system. When the first communication device 14 is a transducer, the first communication interface module 113 may be a transducer interface module.

Figure 6:
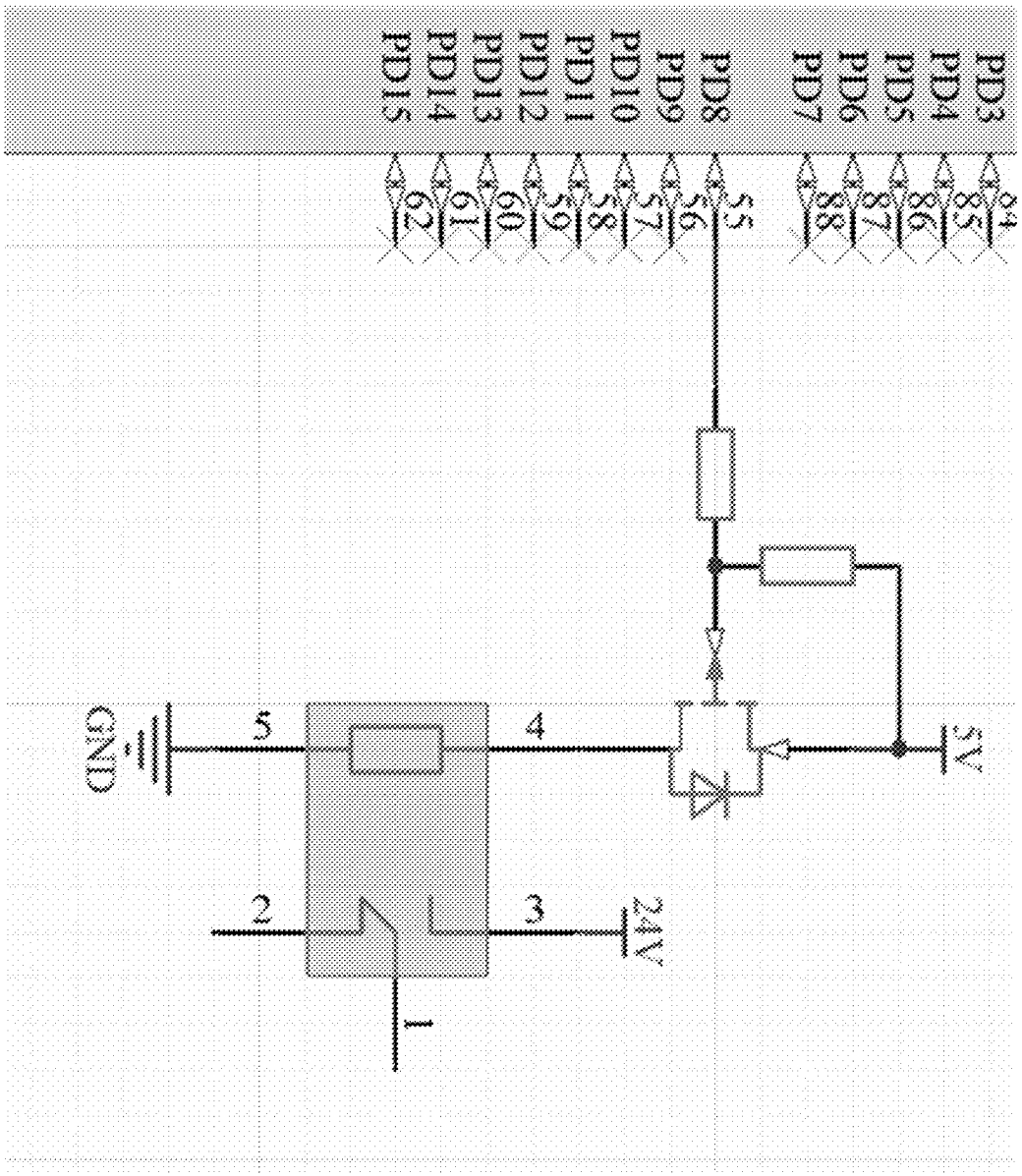
FIG. 6 is an exemplary circuit diagram of a decoupling control module of the buoy apparatus in FIG. 1.

FIG. 6 illustrates an example of a circuit of the decoupling control module 112. The first microprocessor module 111 controls a relay of A PD8 voltage of the first microprocessor module 111 to be ON or OFF. When the relay output from PD8 voltage is ON, the decoupling electric motor device 124 is powered on, and the retractable head of the decoupling electric motor device 124 retracts, the retractable head of the decoupling electric motor device 124 and the first spool flange 122 are separated from each other, and the spool structure 12 is unlocked and the buoy 13 is released from the spool structure 12. Accordingly, the buoy 13 pulls the rope fixed on the rope fixing ring 131 and the entire buoy apparatus 1 rises by buoyancy until the buoy 13 is above the surface of water. When the relay output from PD8 voltage is OFF, the decoupling electric motor device 124 is powered off, and the retractable head of the decoupling electric motor device 124 extends, the retractable head of the decoupling electric motor device 124 and the first spool flange 122 are engaged with each other, and the spool structure 12 is locked as illustrated in FIG. 8B and the ropes are winded on the spool and buoy 13 is pulled to the spool structure from the surface of the water.

In some examples, to avoid the buoy 13 to be stuck between the first and second flanges 122 and 123, a portion, such as 20 cm or less, of the rope connecting to the rope fixing ring 131 may be pulled out from the spool structure 12 to leave a distance between the buoy 13 and the spool structure 12. A shorter distance works better to reduce the interference of the rope to the safe of marine organisms.

Optionally, to make the buoy 13 more obvious and convenient for user's searching, In the example of FIG. 4, the buoy 13 may include a flash cone barrel 137, a wind vane 138 and so on. The buoy 13 may also comprise other suitable structures to clearly identify the buoy 13 on the surface of the water.

Figure 7:
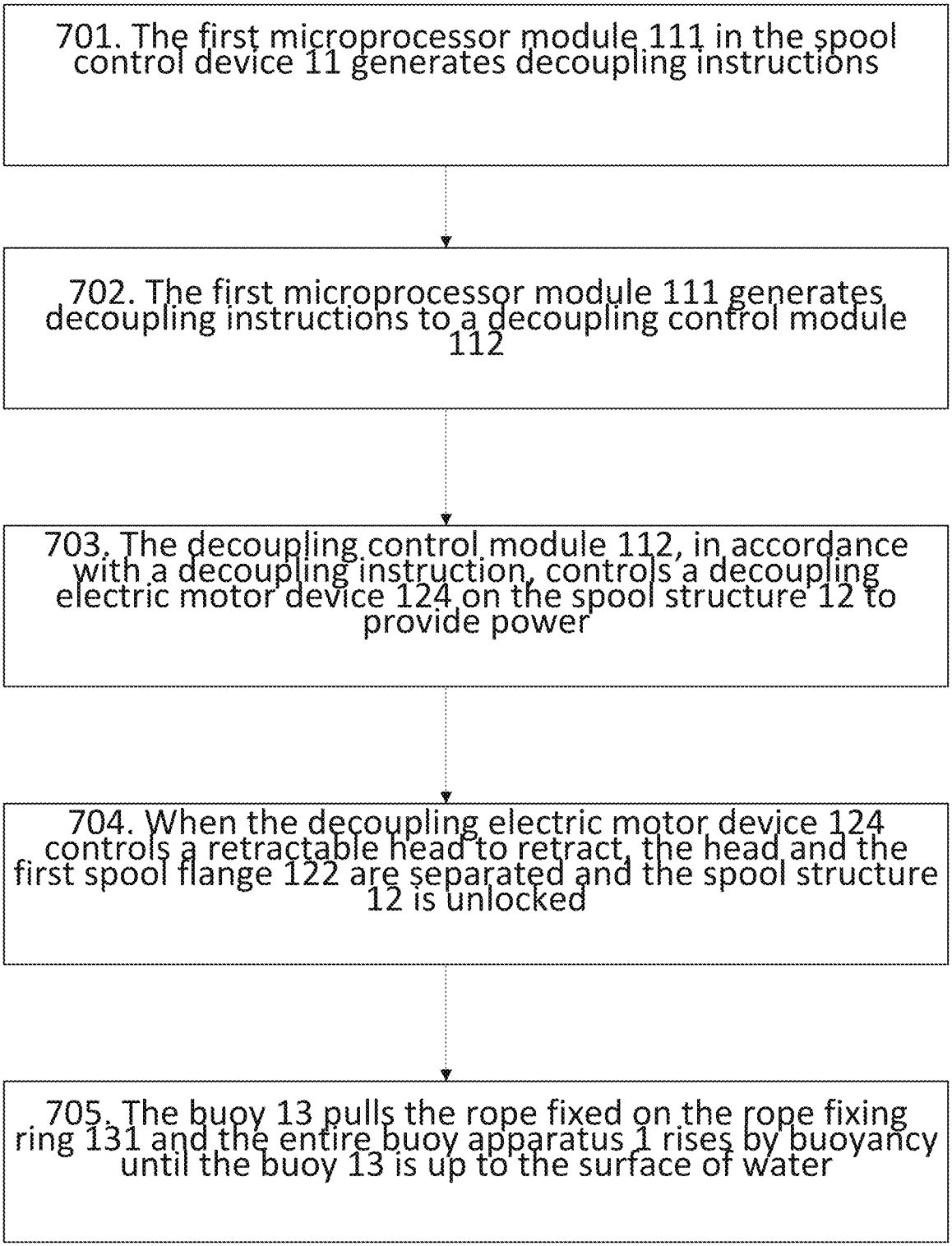
FIG. 7 is a workflow diagram illustrating an exemplary operation process of the buoy apparatus in FIGS. 1 to 6.

FIG. 7 is a flow chart showing an exemplary operation process of the buoy apparatus 1. At step 701, the first microprocessor module 111 in the spool control device 11 generates decoupling instructions. In some examples, the first microprocessor module 111 generates a decoupling instruction based on a pre-set time on a timer. It may also generate a decoupling instruction manually from users through the first communication device 14 as described above. Certainly, there are other methods to generate decoupling instructions, which is not described herein.

At step 702, decoupling instructions generated by the first microprocessor module 111 are transmitted to the decoupling control module 112 from the first microprocessor module 111. The decoupling instructions may be a high or low voltage level signal, such as a Transistor-transistor logic (TTL) signal. In some examples, the first microprocessor module 111 through controlling PD8 pin voltage may send decoupling instructions or HL signals to the decoupling control module 112.

At step 703, the decoupling control module 112, in response to the decoupling instructions received from the first microprocessor module 111, may trigger the decoupling process, for example, by actuating the decoupling electric motor device 124 on the spool structure 12.

At step 704, when the decoupling electric motor device 124 may control a retractable head to retract, the head and the first spool flange 122 are separated and the spool structure 12 is unlocked. When the spool structure 12 is unlocked, in response to an external force, such as buoyancy, the spool structure 12 may rotate to extend or unwind the rope.

At step 705, the buoy 13 may pull the rope with one end fixed on the rope fixing ring 131, and the entire buoy apparatus 1 and the object rises by buoyancy until the buoy 13 is up to the surface of water.

The entire buoy apparatus 1, including the spool structure 12, and the object may be retrieved from the water and the rope may be winded on the spool structure 12 by rotating the spool structure with the handle 125 (FIG. 8A).

By using the first microprocessor module 111 to generate a decoupling instruction for controlling a spool control device 11, a decoupling control module 112 instructs a retractable head of a decoupling electric motor device 124 in the spool structure 12 to extend the rope, When the retractable head extends, the first spool flange is engaged with it. The spool structure 12 is locked and the spool structure 12 is not rotatable. When the retractable head retracts, the first spool flange is released, the spool structure 12 is unlocked. The spool structure 12 is rotatable in response to an external force, such as a buoyancy generated by the buoy 13. Meanwhile, since a rope connects with a buoy 12, buoyancy pulls the rope from the spool structure 12, thereby, bringing the entire buoy apparatus 1 and the object secured on the base 128 floating. Since the rope initially winds around the spool structure 12 before the spool structure 12 is unlocked, there is no rope suspending in the water. Thus, the ropes only suspend in the water when the spool structure 12 is unlocked under instructions or based on needs. As such, with this mechanism, a threat to the survival of marine organisms is significantly reduced by reducing the time of suspending the ropes in the water.

Another embodiment of the present invention further provides a buoy apparatus 1, this buoy apparatus 1 is substantially same as the one depicted from FIG. 1 to FIG. 6. The difference is: as depicted in FIG. 8A, a spool structure 12' may also include a manual spin handle 125 and a rack 99. The manual spin handle 125 may connect to the outer cider the second spool flange 123. The rack 99 is set at the outer side of the first spool flange 122 and may connect to the decoupling electric motor device 124.

By providing a manual spin handle 125 and a rack 99 to the spool structure 12, users can easily rewind the rope around the connecting rods 121 with the manual spin handle 125 after the buoy apparatus 1 is pulled out of the water. Thereby, this buoy apparatus 1 provided by the embodiment of the present invention is further convenient for users.

Figure 9:
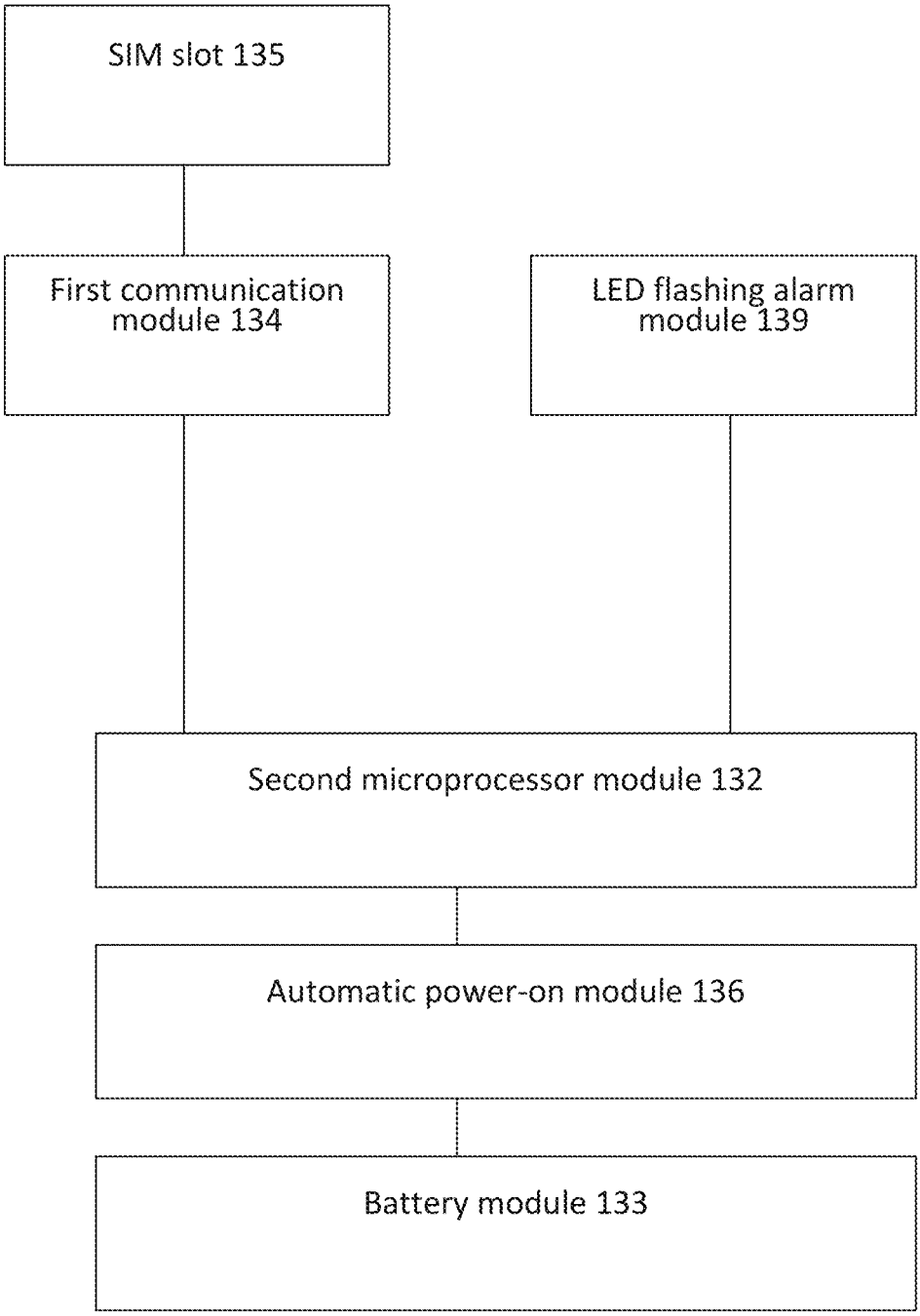
FIG. 9 is a block diagram showing the modules of the buoy if the buoy apparatus in FIG. 1, according to an embodiment of the present disclosure.

FIG. 9 is another embodiment of the present invention providing a buoy apparatus 1. The buoy apparatus 1 is substantially same as the one depicted from FIG. 1 to FIG. 6, except that the buoy 13 may also internally include a second microprocessor module 132, a battery module 133 connecting to the second microprocessor module 132, a first communication module 134 connecting to the second microprocessor module 132 and a subscriber identification module (SIM) slot 135 connecting to the first communication module 134.

In the embodiment in FIG. 9, the buoy apparatus 1 may have a positioning function. Specifically, the second microprocessor module 132 of the buoy 13 generates positioning information for example, by a GPS sensor, as well as transmits the positioning information to users via a SIM card on the SIM slot 135 and the first communication module 134. After a buoy apparatus 1 is floating on the surface of the water, buoy apparatus 1 floats with the current of the water and may get lost. With the positioning function integrated in the buoy apparatus 1, it does not get lost after floating up to the surface of water. Further, since the buoy 13 is provided with a SIM slot 135 for receiving a SIM card, the buoy 13 directly transmits, such as via a public land mobile network, the position information to the corresponding user's mobile phone, mobile terminal devices and so on. There is no need for users to have an additional communication device. In some examples, the SIM slot 135 may also be substitute with a wireless transmitter that may wirelessly communicate, such as the position information of the buoy 13, with a wireless receiver from the user side.

Further, since the buoy apparatus 1 provided by the embodiments of the present invention is applied underwater, to extend the power supply period of the battery module 133 as depicted in FIG. 9, the buoy 13 is internally set with an automatic power-on module 136. One end of the automatic power-on module 136 connects to the battery module 133 and another connects to the second microprocessor module 132. In some examples, the power-on module 136 has a pressure sensor and is configured to electrically connect the battery module 133 with the second microprocessor module 132, when the pressure of the water is less than a threshold value, for example at a pressure level when the buoy 13 raises above the water. As such, the battery module 133 only supply power to the second microprocessor module 132 when the buoy 13 is close to or above the surface of the water. In some examples, the power-on module 136 may include a circuit breaker which is configured to electrically connect the battery module 133 with the second microprocessor module 132 after the breaker is merged in the water for a given period.

It needs to be noted, the embodiment does not limit the specific structure of the automatic power-on module 136. In actual, the automatic power-on module 136 may be designed with any achievable structure.

Figure 10:
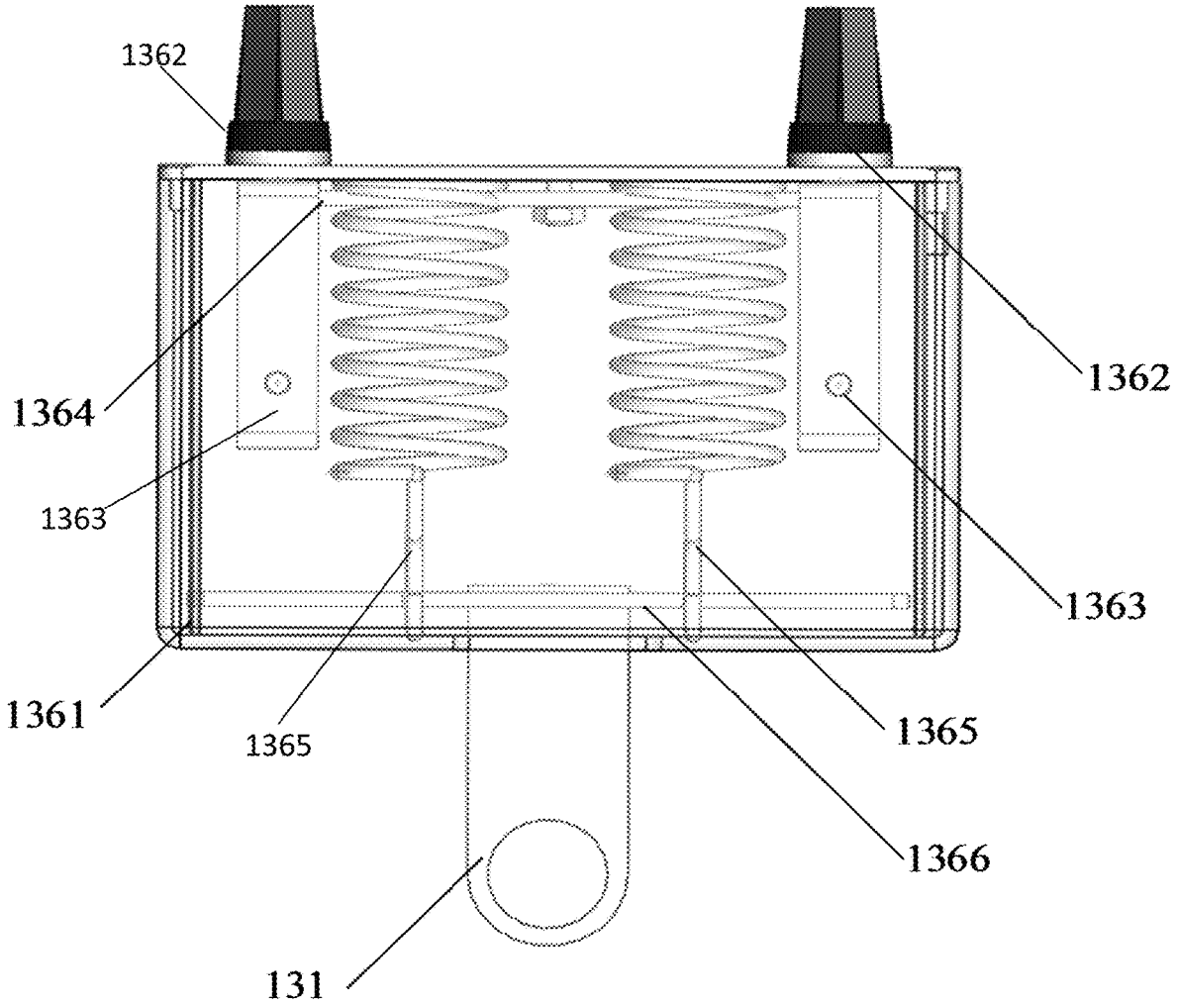
FIG. 10 is a front view of an automatic power-on module of the buoy in FIG. 9, according to an embodiment of the present disclosure.

FIG. 10 illustrates another exemplary configuration of the automatic power-on module 136. In the example of FIG. 10, the automatic power-on module 136 may include a protective cover 1361; the protective cover 1361 is externally set up with two terminals 1362. The two terminals 1362 respectively connect to the positive electrode of the battery module 133 and to the positive electrode of the second microprocessor module 132. The protective cover 1361 is internally set up with two wire columns 1363, a crimping board 1364, two springs 1365 and a conductive plate 1366. The wire columns 1363 respectively connect to the terminals 1362. One end of the springs 1365 connects to the wire columns 1363 via the crimping board 1364 and the other end of the springs 1365 connects to the rope fixing ring 131 via the conductive plate 1366.

In the example of FIG. 10, the automatic power-on module 136 may stretches the springs 1365 by the difference between the buoyancy of the buoy 13 in water and the rope pulling force to the rope ring 131, thereby disconnecting the circuit between the two terminals 1362 and cutting off the power supply. When the rope is released and the buoy 13 floats to water surface, the rope pulling force is configured to be less than the force from the springs 1365, for example, by properly selecting the physical characteristics of the springs 1365, such as the spring constant. At this time, the two springs 1365 retract and the conductive plate 1366 touches the two terminals 1362, thereby connecting the circuit between the two terminals 1362.

Optionally, for convenient use, as depicted in FIG. 9, the buoy 13 may also internally comprise a LED flashing alarm module 139 and so on. Certainly, the LED flashing alarm module 139 is only a specific example. In use, other flashing objects may also be used to meet the requirements, which is not described herein.

Figure 11:
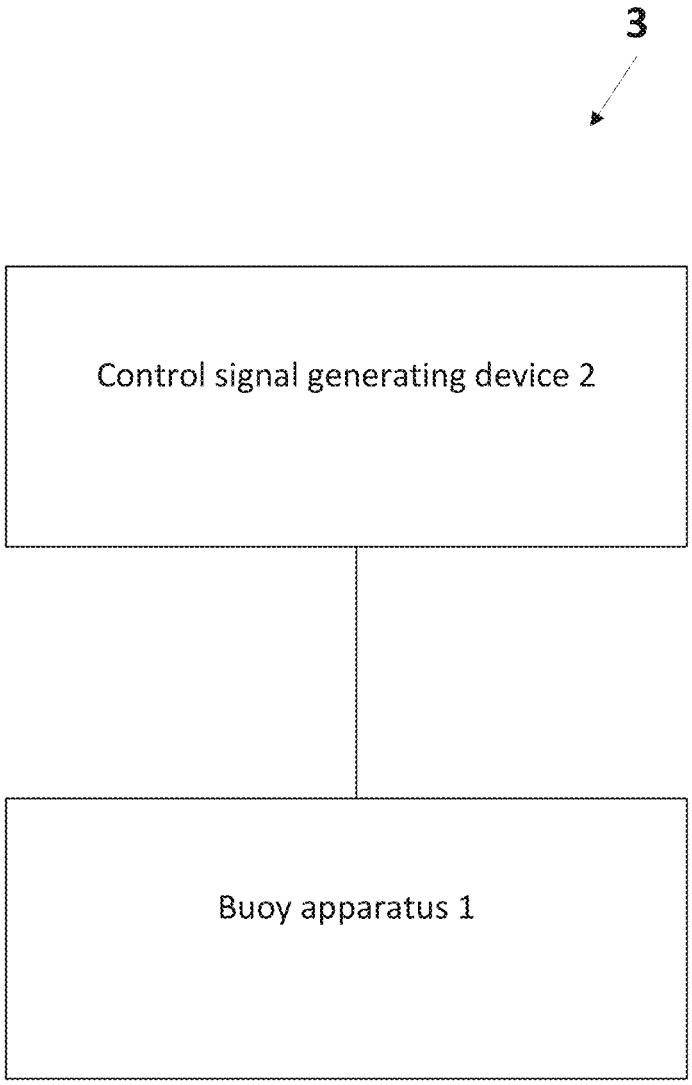
FIG. 11 is a block diagram of a buoy system, according to an embodiment of the present disclosure.

FIG. 11 illustrates another exemplary buoy system 3, which may include a buoy apparatus 1 and a control signal generating device 2. The control signal generating device 2 may be placed on the boat and may be configured to communicate with the communication device 14, such as a Sonar or laser communication device, of the buoy apparatus 1. The buoy apparatus 1 is underwater connecting to underwater objects.

Figure 12:
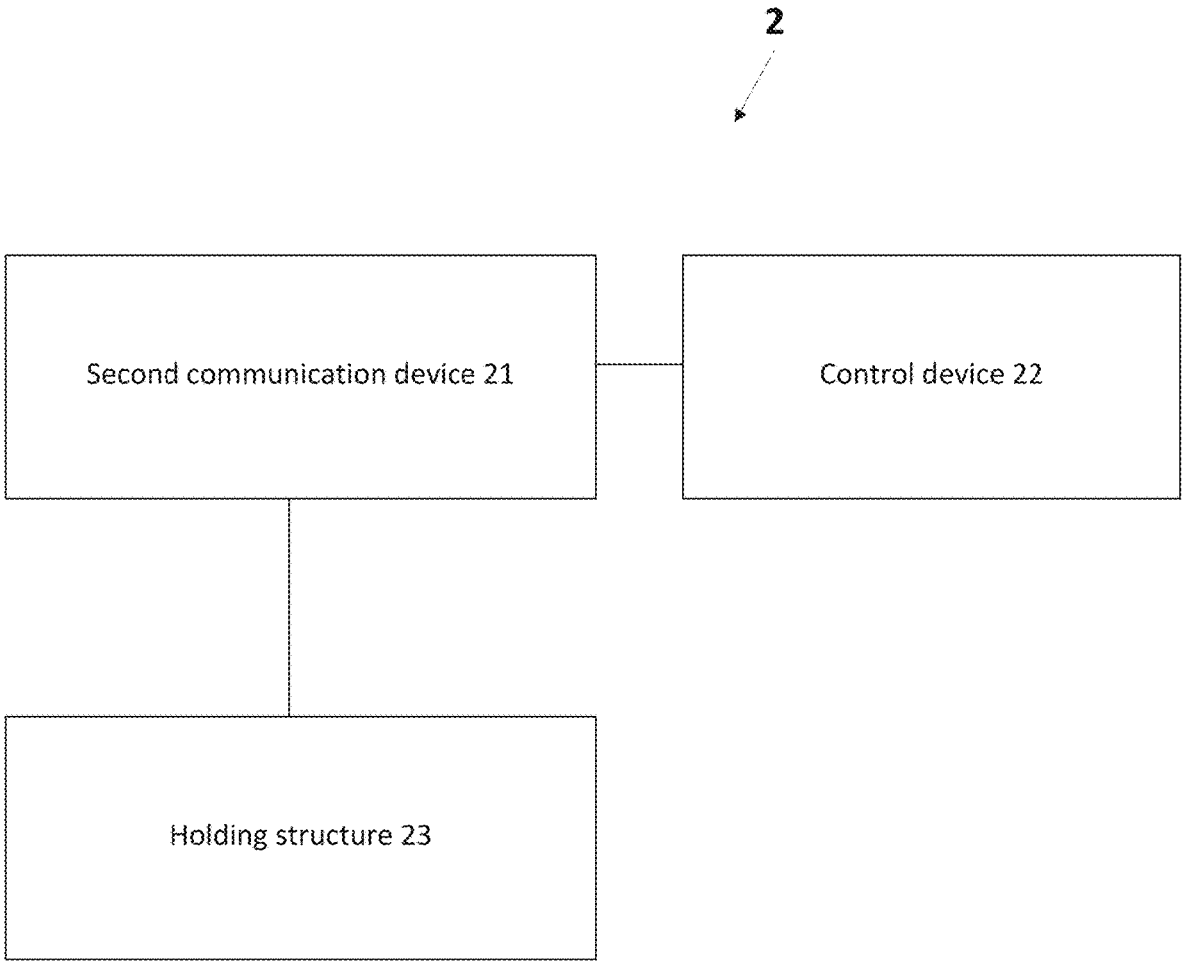
FIG. 12 is a block diagram of a control signal generating device in the buoy system in FIG. 11, according to an embodiment of the present disclosure.

As illustrated in the example of FIG. 12, the control signal generating device 2 may include a second communication device 21, and a control device 22 connecting to the second communication device 21. The second communication device 21 may be a Sonar or laser communications device.

Figure 13A:
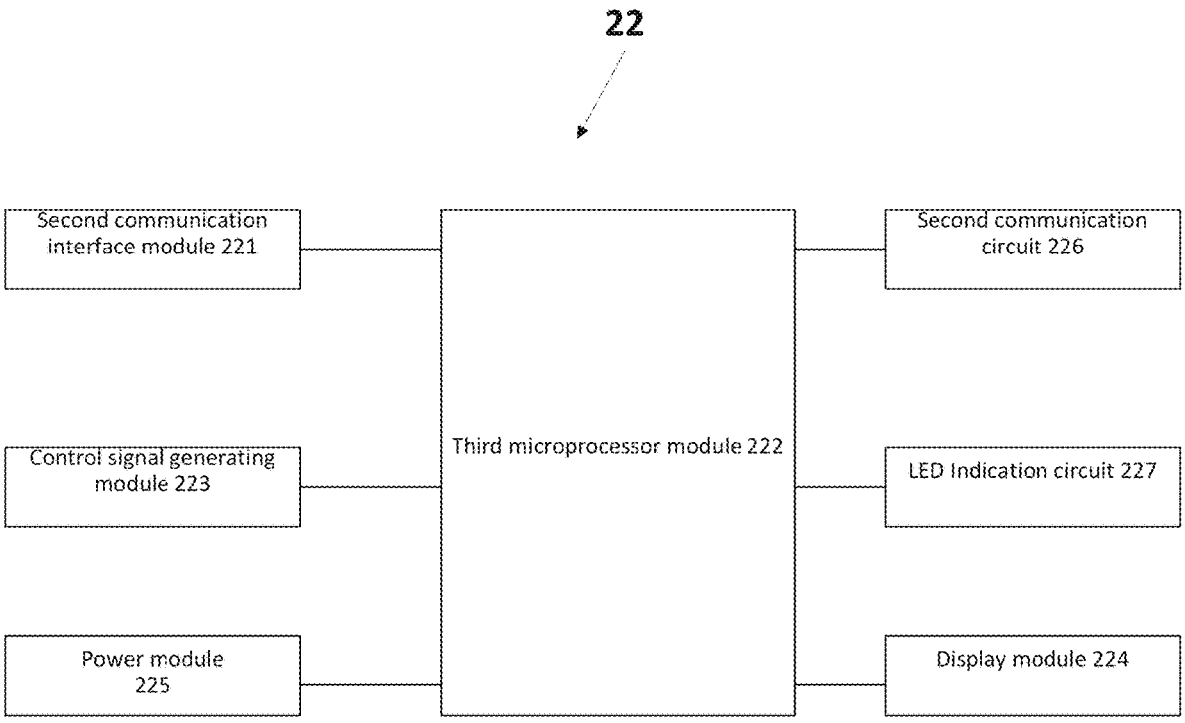
FIG. 13A is a block diagram of a control device hi the control signal generating device of the buoy control system in FIG. 12, according to an embodiment of the present disclosure.

As shown in the example of FIG. 13A, the control device 22 may include a second communication interface module 221, a third microprocessor module 222 and a control signal generating module 223. The second communication interface module 221 has one end connecting to the second communication device 21 and the other end connecting to the third microprocessor module 222. The control signal generating module 223 connects to the third microprocessor module 222.

Figure 13B:
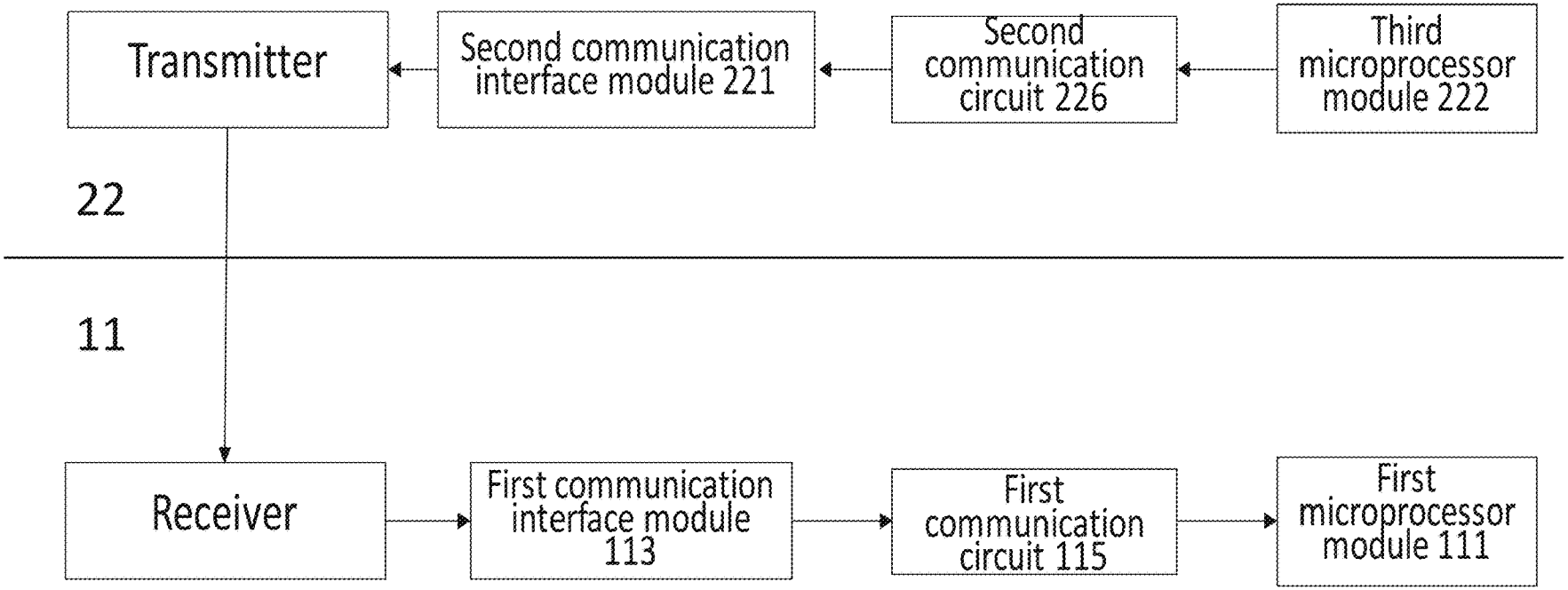
FIG. 13B is a block diagram illustrating a communication process between the control signal generating device in FIG. 12 and the buoy apparatus in FIG. 1.

FIG. 13B illustrates an exemplary communication process between the control device 22 and the spool control device 11. The controller device 22 may be on the boat, and the spool control device 11 may be in the water with the buoy apparatus 1. The user may instruct from the control device 22, for example by pressing a control button of the control device 22, the buoy apparatus 1 to release the buoy 13. In response, the third microprocessor module 222 may send instructions to the second communication circuit 226, for example to encode and modulate the instructions, the second communication interface module 221 may prepare the signal to appropriate form for the transmitter of the second communication device 21 to transmit the signals carrying the instructions. The receiver of the first communication device 14 receives the signals, and transmitted of the signals to the first communication interface module 113 prepare the signals for demodulation and decoding in the first communication circuit 115, and the first microprocessor module 111 receive the instructions from the first communication circuit 115 for triggering decoupling of the retractable head 126, as described above.

The buoy apparatus 1 may be the buoy apparatus 1 as depicted in FIG. 5.

The second communication device 21 may be any electrical communications device, such as a Bluetooth device, an infrared device and so on. Further, similar to the first communication device 14, the second communication device 21 described may be a transducer with low power consumption and anti-interference capabilities, for example, Sonar communication device. When the second communication device 21 is a transducer, the second communication interface module 221 is specifically a transducer interface module.

FIG. 12 is only a specific example of control signal generating device 2. The control signal generating device 2 may have different configurations from the example as illustrated in FIG. 12. For example, the control signal generating device 2 may be any electrical device that is capable to transmit control signals, such as a wireless transmitter, a person computer (PC), a mobile terminal, or other communication devices.

In some examples, the control signal generating device 2 may controls at least one of the buoy apparatus 1. In an example, the control signal generating device 2 may control one buoy apparatus 1, namely that one control signal generating device 2 connects to and controls one buoy apparatus 1. In another example, one control signal generating device 2 may connects with and control multiple buoy apparatuses 1.

Since the control device 22 may include a third microprocessor module 222, the control device may include a power module 225 as depicted in FIG. 13A. The power module 225 may be any power supply module as far as it supplies power, such as a battery.

In the example of FIG. 13A, the control device 22 may also comprise a display module 224 connecting to the third microprocessor module 222. The display module 224 may be configured to display, by the third microprocessor module 222, information of the system 3, for example, the work status of the system 3, position and other information of the buoy apparatus 1, etc.

As depicted in FIG. 13A, the control device 22 may also comprise a second communication circuit 226, a LED indication circuit 227 and other modules. The control device 22 actually are not limited to the modules illustrated in FIG. 13. Other modules, such as GPS module, or Wi-Fi™ Module may also be added to the control device 22.

Optionally, the control signal generating device 2 may also include a holding structure 23. In order to conveniently deploy the control signal generating device 2 on an object above the water, such as boats and so on, as depicted in FIG. 12, the control signal generating device 2 may also comprise a holding structure 23 which is electrically connected with the second communication device 21.

Figure 14:
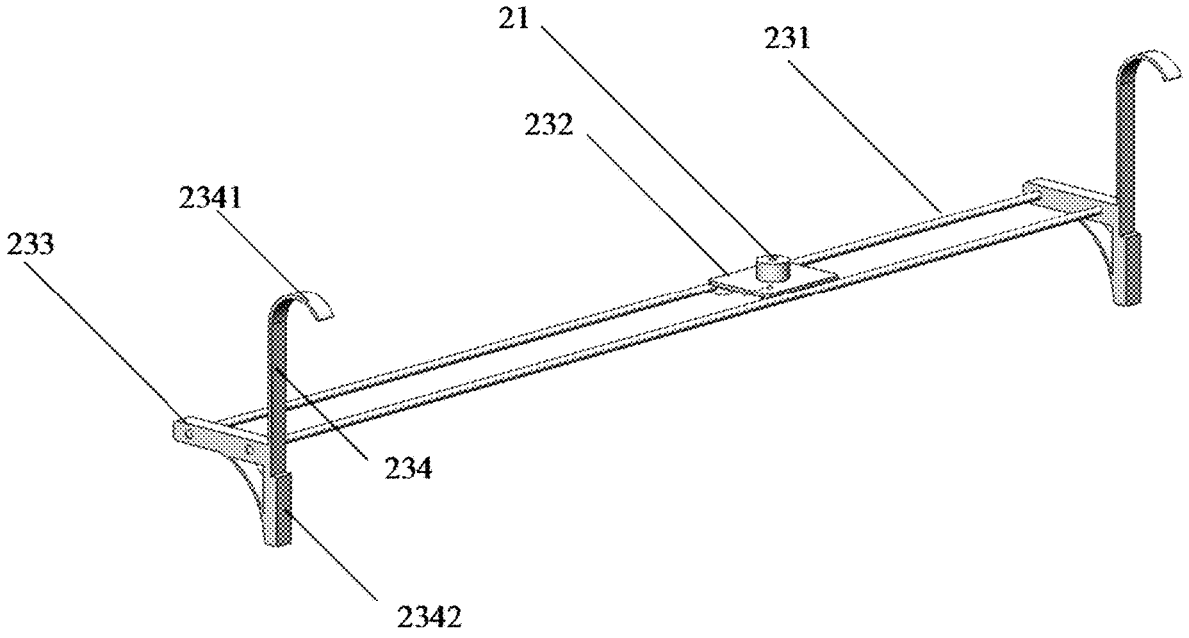
FIG. 14 is a perspective view of a holding structure in the control signal generating device of the buoy system provided in FIG. 12, according to an embodiment of the present disclosure.

The holding structure 23 may be any structure for fixing the control signal generating device 2 on an object, such as a boat, above water. FIG. 14 illustrates an exemplary holding structure 23, which may include two sliding rails 231. A device holding station 232 is slidably placed on the two sliding rails 231. The device holding station 232 is slidable over the sliding rails 231, and the second communication device 21 may be placed on the device holding station 232. The two ends of each sliding rail 231 are respectively held by a bracket 233. Each bracket 233 is securely connected to a fixing portion 234. For example, the holding structure 23 allows the transmission end of a Sonar communication device to be placed under the water, the device holding station 232 allows to adjust the position of the transmission end of the Sonar communication device by sliding over the sliding rails, so that the receiving end of the communication device 14 under the water may be easily receive the instructions, Therefore, the holding structure 23 improves the transmission efficiency of the Sonar communication device. As depicted in FIG. 14, in the present embodiment, to be more stable, each of the fixing portions 234 is consist of two parts, a hook 2341 and a powerful magnet 2342. The fixing portion 234 may also be in other configurations that allows the holding structure 23 be secured on the board. The hook 2341 and powerful magnet 2342 together allows the holding structure 23 to be secured on the object, such as the boat, above the water.

As illustrated in FIG. 14, the second communication device 21 may be fixedly connected on the device holding station 232. Users on the object, for example on the boat, may use the second communication device 21 to wirelessly communicate with the control device 22, for example, to communicate with the second communication circuit 226 via the second communication interface module 221. In some examples, users may communicate control command or instructions to the control device 22 from the second communication device 21 to the second communication circuit 226. In response, the third microprocessor module 222 may trigger the extension or retraction of the rope tied to the buoy apparatus 1.

The embodiments of the present invention may be described in the general context of computer-executable instructions executed by a computer, such as program modules. In general, program modules comprise routines, programs, objects, components, data structures and so on, which perform particular tasks or implement specific abstract data types. The present invention may also be practiced in a distributed computing environment. In the distributed computing environment, tasks are performed by a remote processing device that is connected through a communication network. In the distributed computing environment, program modules may be in a local and remote computer storage medium containing storage devices.

In the context, the relational terms used in this disclosure, such as the first and the second, are used only to distinguish one entity from the others, or one operation from the others, rather than requiring or implying any actual relationship or sequence among the entities or operations. In addition, the terms of "comprise", "include" and any other variants mean to cover non-exclusive inclusions. Thus, they cover not only the procedures, methods, goods or devices of a series of key elements, but also the key elements that are not clearly listed. Or they further cover the key elements inherent to such procedures, methods, goods or devices. Without more restrictions, elements defined in a sentence "comprises one . . . " do not exclude other same elements existing in the procedures, methods, goods or devices of the described elements.

Certain adaptations and modifications of the described embodiments can be made. Therefore, the above discussed embodiments are considered to be illustrative and not restrictive.

The invention claimed is:

1. A buoy apparatus for use underwater, comprising:

a buoy securely connected to a first end of a rope;

a spool structure securely connected to a second end of the rope;

a retractable head for engaging the spool structure; and a spool control device for actuating retraction of the retractable head, wherein in response to an instruction from the spool control device, the retractable head disengages the spool structure, and the spool structure releases the rope when the buoy raises toward a surface of water.

2. The buoy apparatus of claim 1, wherein the said spool control device comprising: a first microprocessor module for generating decoupling instructions and a decoupling control module connecting to said first microprocessor module.

3. The buoy apparatus of claim 1, wherein said spool structure comprises a first spool flange, a second spool flange, a plurality of connecting rods configured to wind the rope1 and a decoupling electric motor device mounted to an outer side of the first spool flange, wherein a first end of the plurality of connecting rods securely connected to the first spool flange, a second end of each of the plurality of connecting rods is securely connected to the second spool flange, wherein the decoupling electric motor device is connected to a central shaft of the spool structure, wherein the first spool flange is engaged with a retractable head of said decoupling electric motor device when the head extending, and wherein when the retractable head of the decoupling electric motor device retracts, the first spool flange is released.

4. The buoy apparatus of claim 1, wherein the buoy has a rope fixing ring at a bottom of the buoy, and the first end of the rope is connected to the rope fixing ring.

5. The buoy apparatus of claim 1, wherein said spool structure further comprises a manual spin handle for winding the rope and a rack, said manual spin handle connecting to said second spool flange, said rack being set at the same side of said first spool flange.

6. The buoy apparatus in claim 1, wherein said buoy further comprises a second microprocessor module, a battery module connecting to said second microprocessor module, a first communication module connecting to said second microprocessor module.

7. The buoy apparatus in claim 6, wherein the first communication module has a SIM slot for receiving a SIM card.

8. The buoy apparatus in claim 6, wherein said buoy further comprises an automatic power-on module for automatically providing power to the second microprocessor module, a first end of said automatic power-on module connecting to said battery module, a second end of said automatic power-on module connecting to said second microprocessor module.

9. The buoy apparatus of claim 8, wherein said automatic power-on module is configured to provide electrical connection between the battery module and the second microprocessor module when the buoy raises close or above the water.

10. The buoy apparatus of claim 8, wherein said automatic power-on module comprises a protective cover; first and second conductive terminals placed outside the protective cover, the first conductive terminal for electrically connecting to a positive electrode of said battery module, and the second conductive terminal for electrically connecting to a positive electrode of the second microprocessor module; said protective cover housing two wire columns, a crimping board, two springs and a conductive plate, said wire columns respectively connecting to said terminals, one end of said springs connecting to said wire columns via said crimping board, the another end of said springs connecting to said rope fixing ring) via the conductive plate.

11. The buoy apparatus according to any one of claim 1 to claim 10, further comprising: a first communication device; said spool control device further comprising a first communication interface module with a first end connecting to said first communication device and with a second end connecting to said first microprocessor module.

12. A buoy control system, comprising the buoy apparatus in claim 11 and a control signal generating device communicating with said buoy apparatus, said buoy apparatus being set up underwater connecting to underwater objects, said control signal generating device being set up for users; wherein, said control signal generating device comprises: a second communication device) and a control device connecting with said second communication device; wherein, said control device comprising: a second communication interface module, a third microprocessor module and a control signal generating module, said second communication interface module with one end connecting to said second communication device and with another end connecting to said third microprocessor module, said control signal generating module connecting to said third microprocessor module.

13. The buoy control system in claim 12, wherein said control device further comprising: a display module, said display module connecting with said third microprocessor module.

14. The buoy control system recited in claim 12, wherein, the control signal generating device also comprising: a holding structure, said second communication device being fixed on said holding structure.

15. The buoy control system recited in claim 14, wherein, said holding structure comprising: two sliding rails; a device holding station being set up on said sliding rails, said device holding station and said sliding rails being connected via sliding in between; the two ends of each said sliding rail being respectively held by a bracket; each said bracket having a fixing portion (234) 1 said bracket and said fixing portion being firmly connected.

* * * * *